United States Patent [19]

Kretzinger

[11] 4,229,868

[45] Oct. 28, 1980

[54] APPARATUS FOR REINFORCEMENT OF THIN PLATE, HIGH PRESSURE FLUID HEAT EXCHANGERS

[75] Inventor: Karl F. Kretzinger, Simi Valley, Calif.

[73] Assignee: The Garrett Corporation, Los Angeles, Calif.

[21] Appl. No.: 955,119

[22] Filed: Oct. 26, 1978

[51] Int. Cl.[3] ..... B23P 15/26

[52] U.S. Cl. ..... 29/157.3 R; 165/166

[58] Field of Search ..... 29/157.3 R, 157.3 C, 29/157.3 D; 113/118 R, 118 C, 118 D; 165/166, 167

[56] References Cited

U.S. PATENT DOCUMENTS

| | | | |
|---|---|---|---|
| 1,999,246 | 4/1935 | Maret | 29/157.3 R |
| 3,017,161 | 1/1962 | Slaasted et al. | 29/157.3 R |
| 3,460,611 | 8/1969 | Folsom et al. | 165/166 |

*Primary Examiner*—Lowell A. Larson

*Attorney, Agent, or Firm*—Henry M. Bissell

[57] ABSTRACT

Special reinforcing members are provided for high pressure containment in critical portions of a thin plate-and-fin heat exchanger. These comprise a plurality of hoops of U-shaped cross section bridging the juncture lines of the heat exchanger manifolds, together with leading edge straps which provide structural reinforcement in the region between the manifolds and the conventional side bar reinforcing members in the central core section. The ends of the leading edge straps are structurally tied respectively to the side bars and the manifold reinforcing hoops.

21 Claims, 8 Drawing Figures

APPARATUS FOR REINFORCEMENT OF THIN PLATE, HIGH PRESSURE FLUID HEAT EXCHANGERS

INTRODUCTION

Heat exchangers incorporating apparatus of the present invention have been developed for use with large gas turbines for improving their efficiency and performance while reducing operating costs. Heat exchangers of the type under discussion are sometimes referred to as recuperators, but are more generally known as regenerators. A particular application of such units is in conjunction with gas turbines employed in gas pipe line compressor drive systems.

Several hundred regenerated gas turbines have been installed in such applications over the past twenty years or so. Most of the regenerators in these units have been limited to operating temperatures not in excess of 1000° F. by virtue of the materials employed in their fabrication. Such regenerators are of the plate-and-fin type of construction incorporated in a compression-fin design intended for continuous operation. However, rising fuel costs in recent years have dictated high thermal efficiency, and new operating methods require a regenerator that will operate more efficiently at higher temperatures and possesses the capability of withstanding thousands of starting and stopping cycles without leakage or excessive maintenance costs. A stainless steel plate-and-fin regenerator design has been developed which is capable of withstanding temperatures to 1100° or 1200° F. under operating conditions involving repeated, undelayed starting and stopping cycles.

The previously used compression-fin design developed unbalanced internal pressure-area forces of substantial magnitude, conventionally exceeding one million pounds in a regenerator of suitable size. Such unbalanced forces tending to split the regenerator core structure apart are contained by an exterior frame known as a structural or pressurized strongback. By contrast, the modern tension-braze design is constructed so that the internal pressure forces are balanced and the need for a strongback is eliminated. However, since the strongback structure is eliminated as a result of the balancing of the internal pressure forces, the changes in dimension of the overall unit due to thermal expansion and contraction become significant. Thermal growth must be accommodated and the problem is exaggerated by the fact that the regenerator must withstand a lifetime of thousands of heating and cooling cycles under the new operating mode of the associated turbo-compressor which is started and stopped repeatedly.

Confinement of the extreme high temperatures in excess of 1000° F. to the actual regenerator core and the thermal and dimensional isolation of the core from the associated casing and support structure, thereby minimizing the need for more expensive materials in order to keep the cost of the modern design heat exchangers comparable to that of the plate-type heat exchangers previously in use, have militated toward various mounting, coupling and support arrangements which together make feasible the incorporation of a tension-braze regenerator core in a practical heat exchanger of the type described.

Heat exchangers of the type generally discussed herein are described in an article by K. O. Parker entitled "Plate Regenerator Boosts Thermal and Cycling Efficiency", published in *The Oil & Gas Journal* for Apr. 11, 1977.

BACKGROUND OF THE INVENTION

1. Field of the Invention

This invention relates to heat exchangers and, more particularly, to special reinforcing structure for thin plate-and-fin heat exchangers.

2. Description of the Prior Art

Many different approaches are known in the prior art to dealing with the problem of pressure containment and structural reinforcement in thin plate heat exchangers. External framework such as the heat exchanger strongback described above is disclosed in the Flurschutz et al U.S. Pat. No. 2,997,279. Internal spacing and reinforcing structure is also well known, as exemplified by the disclosures of the Ladd U.S. Pat. No. 2,952,445 and Rosenbald U.S. Pat. No. 3,229,763. The use of side bars as reinforcing and spacing members for a thin plate-and-fin heat exchanger structure is exemplified by U.S. Pat. No. 4,006,776 of Pfouts et al. The Flower U.S. Pat. No. 3,780,800 discloses separate bands extending about a heat exchanger core in planes perpendicular to the direction of gas flow which permit the core to expand without thermal restraint. The Jacobsen et al U.S. Pat. No. 3,894,581 discloses self reinforcement in a formed plate heat exchanger wherein overlapping manifold sections are provided to develop reinforcement of the abutting juncture lines and flange portions of the manifold sections. Finally, the aforementioned Ladd patent discloses special leading edge fins in a plate type heat exchanger which are of specially strengthened material and are positioned at the entrance end of a duct for resisting damage from entrained particles in a high velocity ambient air stream.

None of the known arrangements disclosed in the prior art relates to the provision of reinforcing members of the type involved in the present invention for the formed plate heat exchangers to which it is applied.

SUMMARY OF THE INVENTION

In brief, particular arrangements in accordance with the present invention comprise reinforcing hoops integrally brazed within the heat exchanger core to provide reinforcement of the manifold sections thereof. These arrangements also include leading edge strap which form beam sections structurally connecting the hoops and associated reinforcing side bars in the central section of the heat exchanger core. The leading edge straps also function as heat sinks to limit the thermal shock under sudden temperature changes encountered during transitional operation.

Heat exchanger structure to which the present invention is applicable is constructed of a plurality of formed plates and fins brazed together into a complete unit comprising manifolds and heat exchanging core in a single counter-flow device. The respective end portions of the heat exchanger plates are formed with a peripheral flange which, when joined with the corresponding flange of an adjacent formed tube plate, provides a boundary seal for containing the air fin passages provided by the thus-joined pair of heat exchanger plates. Each end portion of the formed tube plate contains an opening encircled by a collar portion, thus defining a manifold section through the plate. The collar portion is cut back along the side facing the core portion so as to provide communication between the manifold section and the air fin passages.

The formed tube plate also includes a ring offset from the plane of the plate and extending about the manifold opening. This ring, which in cross section resembles a U-shaped trough, has a flat base portion which, when joined by brazing with the flat base portion of an adjacent tube plate in back-to-back relationship, serves to provide spacing between the thus-joined plates for the gas fin passages and to seal the manifold sections of the joined heat exchanger plates from the gas passages.

Brazed joints between flat surfaces are relatively weak in the direction of tension. The air passages, including the manifolds, of these heat exchangers are pressurized to a level in the range of from 100 to 150 psi or more. There is thus a very large force on the order of many thousands of pounds tending to separate the brazed junctures between the flanges and trough portions of the formed plate and sections. The flat plates of these heat exchangers can be held together by brazing to the respective air and gas fins positioned therein. However, in the manifold sections proper, without more, there is no reinforcing means and the brazed manifold sections would therefore be subject to rupture from internal pressure forces.

The reinforcing hoops provided in accordance with the present invention are of thicker material than the associated thin plates and, by virtue of this fact and their position and structural configuration, provide reinforcement for the joints at both the flanges and the trough portions of the manifold sections. The hoops in cross section extend across the juncture plane between the trough portions of the brazed tube plates, thus reinforcing this juncture plane. The hoops extend between the flanges of two adjacent plates, thus also providing compressive load support for the flange joints. The hoops entirely encircle the manifold opening, each within a single gas fin passage, thus providing the desired reinforcement, as described, completely around the manifold section opening.

The leading edge straps extend along the edge flange of the tube sheet end section between the manifold hoops and the side bars which provide edge reinforcement in the central portion of the heat exchanger. The hoops are shaped with a transition section to accommodate the spacing of the leading edge straps. The straps are structurally joined at their opposite ends to the side bars and hoops, respectively, thus providing maximum strength and support for the pressurized core passages.

The use of separate reinforcing hoop members and edge straps allows the selection of material for these members based on optimum strength per dollar at the design temperature without being limited by the design considerations and selection of material for the tube plates per se. The configuration of the straps and hoops permits ready assembly of the overall structure by interleaving these members with the respective tube plates and fins during the makeup of the stacked heat exchanger structure prior to the brazing step.

BRIEF DESCRIPTION OF THE DRAWING

A better understanding of the present invention may be had from a consideration of the following detailed description, taken in conjunction with the accompanying drawings, in which.

DESCRIPTION OF THE PREFERRED EMBODIMENTS

Figure 1:
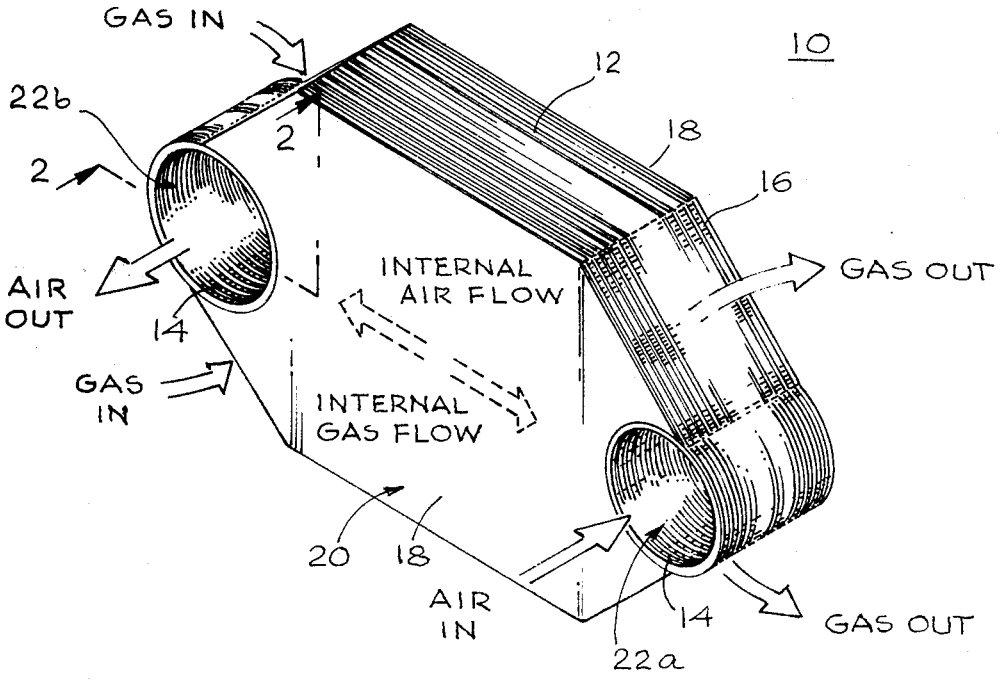
FIG. 1 is a diagrammatic view in perspective of a heat exchanger core section including apparatus of the present invention.

FIG. 1 illustrates a brazed regenerator core as utilized in heat exchangers of the type discussed hereinabove. The unit 10 of FIG. 1 is but one section of a plurality (for example, six) designed to be assembled in an overall heat exchanger module. The core section 10 comprises a plurality of formed plates 12 interleaved with fins, such as the air fins 14 and the gas fins 16, which serve to direct the air and exhaust gas in alternating adjacent counterflow passages for maximum heat transfer. Side plates 18, similar to the inner plates 12 except that they are formed of thicker sheets, are provided at opposite sides of the core section 10. When assembled and brazed to form an integral unit, the formed plates define respective manifold passages **22*a* and 22*b* at opposite ends of the central counterflow heat exchanging section 20** and communicating with the air passages thereof.

As indicated by the respective arrows in FIG. 1, heated exhaust gas from an associated turbine enters the far end of the section 10, flowing around the manifold passage **22*b*, then through the gas flow passages in the central section 14 and out of the section 10 on the near side of FIG. 1, flowing around the manifold 22*a*. At the same time, compressed air from the inlet air compressor for the associated turbine enters the heat exchanger section 10 through the manifold 22*a*, flows through internal air flow passages connected with the manifolds 22*a*, 22*b* and through the central heat exchanging section 20, and then flows out of the manifold 22*b*** from whence it is directed to the burner and associated turbine (not shown). In the process the exhaust gas gives up substantial heat to the compressed air which is fed to the associated turbine, thereby considerably improving the efficiency of operation of the regenerated turbine system.

Figure 2:
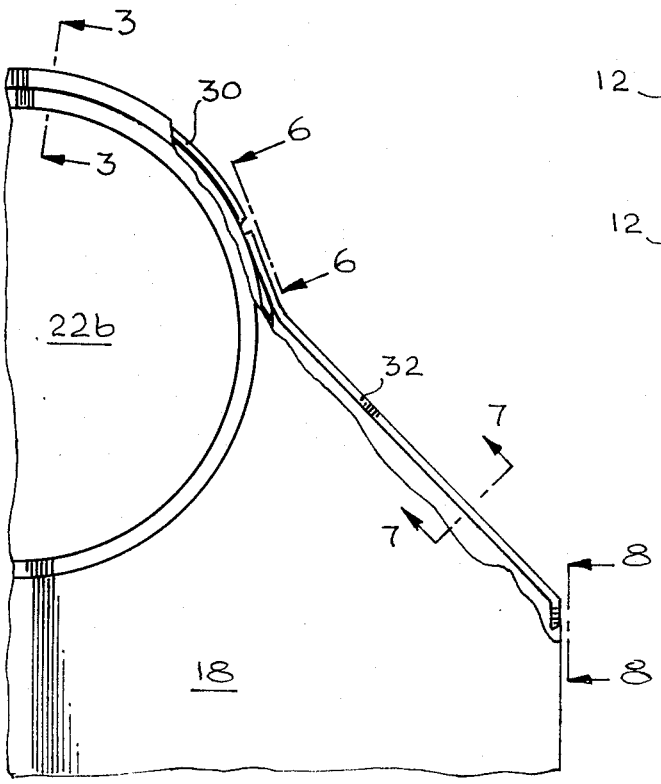
FIG. 2 is an elevational view, partially broken away of a portion of the heat exchanger of FIG. 1, taken along the line 2—2.

FIG. 2 is a view taken at the line 2—2 of FIG. 1, showing a portion of the manifold **22*b* and adjacent core strcture. Although this is indicated as showing a portion of the air outlet manifold 22*b*, the core section 10 of FIG. 1 is symmetrical except for the slight difference in size between the manifolds 22*a* and 22*b*, and therefore the view of FIG. 2 can as well represent a portion of the core section 10 at the air inlet manifold 22*a***.

In FIG. 2, the side plate 18 is partially broken away to show a reinforcing hoop 30 which in turn is partially broken away to show a flat strap 32 extending from the region of the hoop 30 along the edge portion of the core section 10 to the vicinity of the central, counter-flow heat exchange section. The extent of the strap 32 is along the region of the gas inlet or outlet passages, as the case may be.

Figure 3:
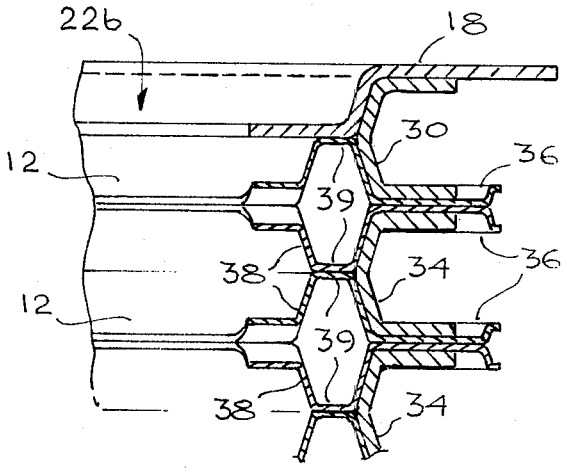
FIG. 3 is a sectional view taken along the line 3—3 of FIG. 2.

FIG. 3 shows a sectional view of a portion of the heat exchanger manifold section, taken at the line 3—3 of FIG. 2. This shows the side plate 18, an outer hoop 30 and a pair of inner hoops 34 mounted in reinforcing position relative to inner plates 12. The inner plates 12 are shaped with circumferential flange portions 36 which partially surround the manifold opening 22*b*. Each inner plate 12 is formed with an offset ring portion shown as a trough or U-shaped section 38, the bases 39 of which are brazed together in sealing relationship. The hoops 30 and 34 extend across the juncture plane between the base portions 39 and are brazed to the adjacent surfaces of the tube plates 12 and 18, thus serving to reinforce the manifold structure against rupture of the base portion joints.

Figure 4:
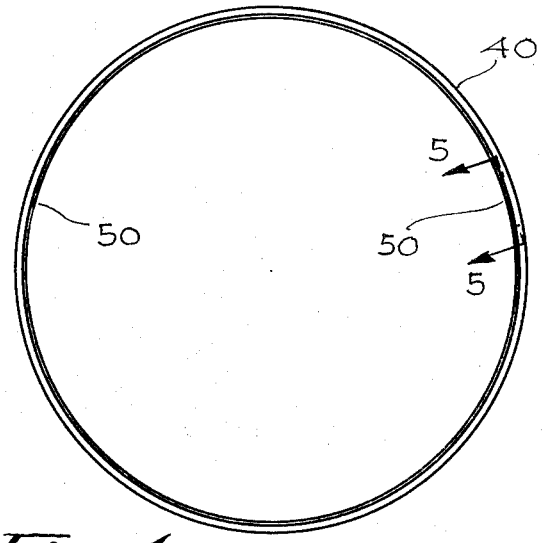
FIG. 4 is a plan view of one of the elements in accordance with the present invention as included in the heat exchanger of FIG. 1.
Figure 5:
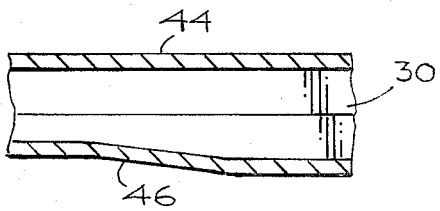
FIG. 5 is a sectional view taken along the line 5—5 of FIG. 4.
Figure 6:
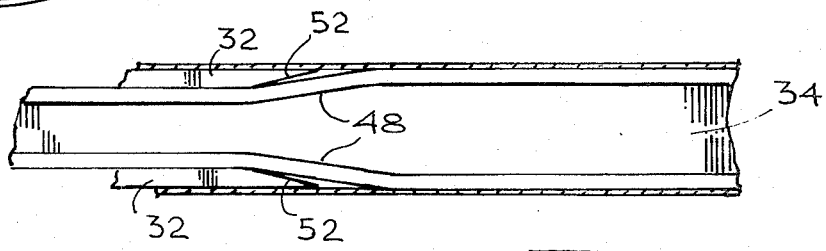
FIG. 6 is a partial sectional view taken along the line 6—6 of FIG. 2.

On such hoop, designated 40, is shown in FIG. 4. This hoop 40 may be considered to represent either an inner hoop 34 or an outer hoop 30. It is circular in plan view, generally U-shaped in cross section and extends entirely around the opening of the manifold 22 as shown in FIG. 3. The inner portion adjacent the central heat exchange portion of the core 10 (FIG. 1) is of reduced thickness (i.e., the direction normal to the U-shaped cross section), relative to the outer portion, over slightly more than half the hoop circumference and is provided with two symmetrically positioned transition sections where the change is thickness is effected. One such section for an outer hoop 30 is shown in FIG. 5, a sectional view taken along the line 5—5 of FIG. 4. FIG. 6 shows a corresponding view of a transition portion of an inner hoop 34.

As shown for the transition portion of the outer hoop 30 of FIG. 5, the upper side 44 is planar, while the transitional change is thickness is accomplished in the lower side 46. In the inner hoop 34 (FIG. 6) both the upper and lower sides 48 are provided with symmetrical transition or angled portions changing the thickness of the hoop at points 50 (FIG. 4).

As indicated in FIG. 6, these transition portions with the reduced thickness of the hoop 30 and 34 serve to accommodate one end of the strap 32 which, it will be noted, is scarfed or tapered at the extreme end 52 to fit the transition portion. As the hoop 50 continues about the manifold opening 22*b* past the area of contact with adjacent straps 32, the spacing developed between adjacent hoop portions of reduced thickness serves to accommodate the air fins 14 (FIG. 1) which extend between the hoops 30, 34 in air passages communicating with the manifolds 22*a*, 22*b*.

Figure 7:
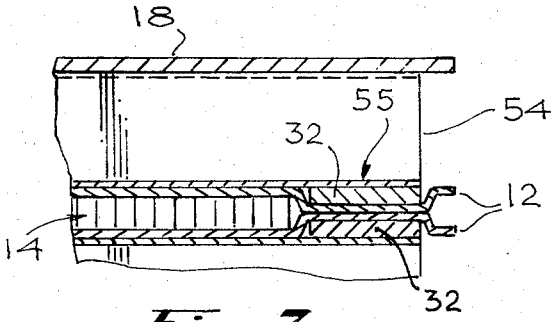
FIG. 7 is a sectional view taken along the line 7—7 of FIG. 2.
Figure 8:
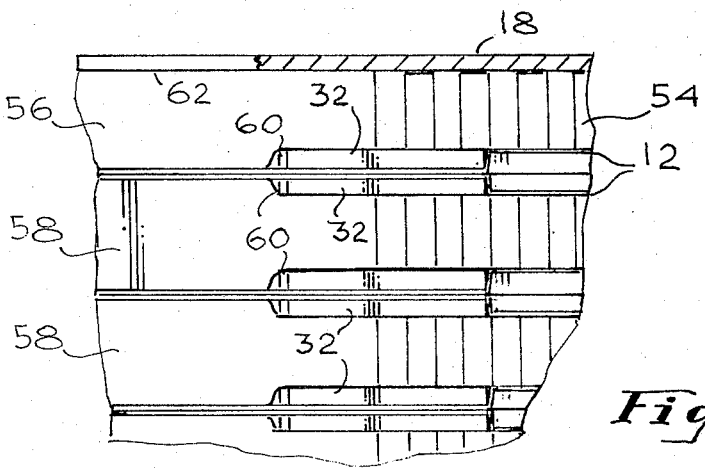
FIG. 8 is a partial side elevational view taken at the line 8—8 of FIG. 2.

The straps 32 provide desirable spacing between adjacent gas fins and reinforcement of the brazed flanges of the tube plates in the region between the hoops 30, 34 and the side bars which define the edges of the heat exchanger section 12 in the central, counterflows section. This is depicted in FIGS. 7 and 8 which show the relationship of the straps 32 to the gas fins 54, the tube plates 12 containing the air fins 14, and the side bars 56, 58. Since the two straps 32 are on opposite sides of the flanges of the tube plates 12 in a region where these flanges are abutting, whereas the air fin 14 is contained between the tube plates in a region where the tube plates are spaced apart, it will be seen that the straps 32 together equal the air fin element 14 in thickness and, being identical, each strap 32 equals one-half the thickness of the air fin 14.

Reference numeral 55 designates the braze material joining together the adjacent elements. Each side bar 56 or 58, as the case may be, is cut out at its end portion to provide a space for receiving the ends 60 of the strap 32. The outer side bar 56 is cut away on only one side, since its outer surface 62 is continuous adjacent the outer plate 18. The inner side bars 58 are cut away on both sides to accommodate corresponding ends 60 of straps 32 on both sides of these side bars. The straps 32 are thus structurally tied to the adjacent reinforcing structure of the heat exchanger core 10 at the opposite ends of the straps 32. The ends 60 are engaged by the overlapping, cut out ends of the side bars 56, 58 as shown in FIG. 8. The opposite ends 52 (see FIG. 6) are overlapped by a reduced thickness portion of adjacent hoops such as 34. In all instances, these overlapping portions of ends of the straps 32 with the side bars 56, 58 and the hoops 30, 34 are brazed into a solid reinforcing structure to accomplish the desired reinforcement and containment of the air passages between the tube plates 12 and the region of the straps 32. The corresponding reinforcement of the respective manifold sections 22, as described hereinabove, is effected by the supporting arrangements of the hoops 30, 34 which are also brazed to the tube plates 12 and the side plates 18. The straps 32 also serve to reinforce the manifold sections against deformation from thermal expansion since the outer portions of the manifolds, being in the form of an arch, have a greater tendency toward thermal deformation than the inner portions where the fins provide support.

A heat exchanger core section 10 is assembled by stacking the various inner plates 12, air fins 14 and gas fins 16, in repetitive sequence with the inner hoops 34, straps 32 and inner side bars 58 between outer plates 18, outer hoops 30 and outer side bars 56, after which the entire assembly is brazed into a rigid intergral unit. Each outer plate 18 is formed, as by stamping, from a planar sheet with an inwardly offset ring portion surrounding each manifold opening. The inner plates 12 are formed from planar sheets with T-shaped ring portions surrounding the manifold openings and offset from the plane of the plate in a first direction. The ring portions of both inner and outer plates are offset by approximately one-half the thickness of the gas fins. The inner plates 12 are also provided with flanges extending along their opposite ends and about the outer portions of the manifold openings outside the ring portions. The flanges are reversely offset from the ring portions—i.e., in a direction from the plane of the plate opposite to that of the U-shaped ring portions—by approximately one-half the thickness of the air fins. Each repetitive segment of the heat exchanger core comprises a pair of tube plates in back-to-back relationship—i.e., with the flanges adjacent each other and the U-shaped ring portions opposed—together with associated air fins, gas fins, hoops, straps and side bars.

In assembling the heat exchanger components, an outer plate 18 is first laid down with its offset portions facing upward. An outer loop is then placed about each manifold opening in the outer plate and a layer of gas fins and outer side bars is placed thereon in the manner shown in FIGS. 3, 7 and 8, but inverted. Straps 32 are placed in position against the outer hoops 30 and side bars 56 and extending along adjacent portions of the gas fins 54. An inner plate 12 is next laid down with the ring portion side down, bearing against the offset portion of the outer plate, and the flange side up. A layer of air fins 14 is then placed in position, after which another inner plate 12 is laid on top of th assembly, but inverted from the attitude of the previously-placed inner plate 12 so that its flange abut with the flanges of the adjacent plate. Next a layer of gas fins, inner hoops, edge straps and inner side bars is placed in position, followed by the next inner plate of the next segment, etc., with th sequency being repeated until the assembly is completed and the outer hoops, side bars and plate on the upper side are applied to complete the stacked assembly. The assembly is then placed in a brazing oven to braze the entire assembly as a complete unit, brazing compound having been placed prior to assembly on all adjacent surfaces which are to be brazed. During assembly, spot welding is used to affix the various elements in place.

The arrangement of the manifold pressure containment hoops and the leading edge straps as separate elements which are integrally brazed and tied together with the central section side bars within the heat exchanger core advantageously permits the separate design of these elements for optimum strength and other desirable properties. The materials employed for these elements and the increased thickness relative to the thin tube plates which are afforded by this design serve to provide additional strength where needed in the heat exchanger. The edge straps form beam sections bridging the portion between the manifold hoops and the central core section side bars and, at least on the gas inlet side of the heat exchanger, beneficially function as heat sinks which assist in reducing the thermal shock which otherwise might be encountered by the tube plate leading edges during lightoff and shutdown of the associated turbine.

Although there have been shown and described herein particular apparatus for reinforcement of thin plate, high pressure fluid exchangers in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

I claim:

1. Apparatus for the reinforcement of thin plate heat exchangers fabricated of stacked tube plates defining fluid passages and having manifold sections integrally formed with the heat exchanging sections thereof comprising:

a plurality of hoops positioned respectively between pairs of adjacent plates which are joined together in sealing relationship, each hoop being configured to extend from one adjacent plate to the next and overlap a common juncture of said plates, said hoop being joined in structural reinforcing relationship to the adjacent surfaces of said plates;

the plates being formed with outer flange portions and offset U-shaped ring portions about at least part of the manifold sections of the heat exchanger, each U-shaped ring portion having a base for joining to the base of the ring portion of the adjacent plate to develop a juncture plane for two adjacent plates; and wherein the associated hoop is generally U-shaped in cross section, extends across the juncture plane and is brazed to the adjacent plates on both sides of the juncture plane and at both the flange and ring portions of the plates.

2. The apparatus of claim 1 wherein the manifold sections include substantially circular openings in the plates and wherein the hoops are mounted about said openings.

3. The apparatus of claim 1 wherein said hoops are joined to said plates by brazing.

4. The apparatus of claim 1 wherein the hoops are formed of material thicker than at least some of said plates to provide added resistance to deformation of the plate from internal fluid pressure.

5. The apparatus of claim 1 wherein each hoop is formed with a portion of reduced thickness to provide a space between adjacent hoops providing access between the manifold and selected fluid passages of the heat exchanger.

6. The apparatus of claim 5 wherein the hoops are provided with transition sections symmetrically positioned along the hoops for joining the two sections of the hoop of different thickness.

7. The apparatus of claim 6 wherein the hoops in the vicinity of said transition sections are spaced to accommodate adjacent beam support members in a common structural reinforcing combination.

8. The apparatus of claim 1 wherein the plurality of hoops comprises a first outer hoop adjacent a side plate of the heat exchanger core and having a thickness transition portion comprising a planar wall along one side of the hoop and an angled wall along the other side of the hoop, the planar wall side of the hoop being positioned adjacent a corresponding surface of the side plate.

9. The apparatus of claim 1 or claim 8 wherein the plurality of hoops further comprises an inner hoop having a symmetrical thickness transition portion with angled walls on opposite sides of the hoop, said inner hoop being mounted between a pair of inner tube plates.

10. The apparatus of claim 1 further comprising a plurality of flat straps extending from said hoops along adjacent edges of the heat exchanger tube plates, each of the straps being joined at one end to an adjacent hoop portion.

11. The apparatus of claim 10 wherein the heat exchanger includes a plurality of reinforcing side bars extending along opposite sides of the heat exchanger, and wherein said straps extend between and are fastened respectively to the side bars and the hoops.

12. The apparatus of claim 11 wherein the ends of the side bars are cut back to receive adjacent ends of the straps in supporting overlapped relationship.

13. The apparatus of claim 10 wherein the hoops include transition sections having sides angled between hoop portions of different thickness and the ends of the straps adjacent the hoops are scarfed to match the angled surface of the transition sections of the hoop.

14. The apparatus of claim 10 wherein the tube plates are interleaved respectively with gas fins and air fins in respective fluid passages and the thickness of the straps is selected to fill the space between a flange portion of a tube plate and an adjacent gas fin of the heat exchanger core.

15. The apparatus of claim 14 wherein the thickness of each strap is approximately equal to one-half the thickness of the air passage between two tube plates.

16. The apparatus of claim 1 wherein the heat exchanger includes a plurality of reinforcing side bars and edge straps and wherein the peripheral flange portions extending about the manifold openings in the tube plates also extend along the edges of the tube plates to a juncture with the side bars, and wherein said straps are mounted along the juncture planes of the flange portions on opposite sides thereof to stengthen the flange junctures against separation.

17. The method of providing reinforcement for integral manifold sections located at opposite ends of a heat exchanger fabricated of stacked formed plates and fins comprising the steps of:

forming a plurality of hoops to conform in configuration and dimension to the outer surfaces of offset ring portions surrounding manifold openings in respective plates, each plate being provided with a flange portion extending along a part of the ring portion of the plate and reversely offset therefrom;

the step of forming the hoops further comprising providing side walls of the hoops configured to contact the ring and flange portions of the plates;

inserting during the stacking of the plates said plurality of hoops respectively between adjacent pairs of plates on the ring portion sides of the plates in positions surrounding said ring portions and in surface contact with the ring and flange portions; and brazing the thus-assembled plates and hoops to adhere the contacting surfaces of the hoops and the ring and flange portions.

18. The method of claim 17 wherein the step of forming the hoops further includes forming a portion of reduced thickness with transition sections joining portions of a hoop of different thickness, and further comprising the step of inserting the end of a flat edge strap to bear against the reduced thickness portion of the hoop in the vicinity of a transition section.

19. The method of assembling a heat exchanger core comprised of a plurality of formed plates and fins, wherein each plate includes integral manifold sections at opposite ends thereof, comprising the steps of:

laying down a first tube plate formed with ring portions offset from the plane of the plate, the ring portions surrounding manifold openings in the plate, and edge flanges extending along opposite ends of the plate;

placing a plurality of air fins on said plate in positions to define air flow passages between opposite manifold sections;

placing a second tube plate inverted relative to the first tube plate over the first tube plate and the air fins;

placing a plurality of reinforcing hoops and gas fins over the second tube plate, the gas fins being positioned to define gas flow passages from one end of the heat exchanger core to the other around the manifold sections, the hoops being positioned to surround the respective manifold openings and surrounding ring portions and in surface contact with adjacent ring portion and flange surfaces;

repeating the cycle of steps to develop a stacked assembly of heat exchanger core elements; and brazing the entire assembly to form an integral unit.

20. The method of claim 19 further comprising the step of inserting flat edge straps along portions of the plate flanges and extending partially between the hoops and the flange portions adjacent thereto for structural reinforcement.

21. The method of claim 20 further comprising positioning the straps to engage structural side members of the core remote from the hoops for providing beam section reinforcement between the hoops and the side members.

* * * * *